US011067070B2

(12) United States Patent
Jang et al.

(10) Patent No.: US 11,067,070 B2
(45) Date of Patent: Jul. 20, 2021

(54) CYLINDER ASSEMBLE STRUCTURE FOR COMPACT AIR COMPRESSOR

(71) Applicant: NEW MOTECH CO., LTD., Gwangju (KR)

(72) Inventors: Jeong Cheol Jang, Gwangju (KR); Jong Hyuk Kim, Gwangju (KR); Jin Sun Park, Gwangju (KR)

(73) Assignee: NEW MOTECH CO., LTD., Gwangju (KR)

( * ) Notice: Subject to any disclaimer, the term of this patent is extended or adjusted under 35 U.S.C. 154(b) by 34 days.

(21) Appl. No.: 16/491,156

(22) PCT Filed: Apr. 4, 2018

(86) PCT No.: PCT/KR2018/003978
§ 371 (c)(1),
(2) Date: Sep. 4, 2019

(87) PCT Pub. No.: WO2018/212452
PCT Pub. Date: Nov. 22, 2018

(65) Prior Publication Data

US 2020/0011312 A1 Jan. 9, 2020

(30) Foreign Application Priority Data

May 18, 2017 (KR) ..... 10-2017-0061548

(51) Int. Cl.

| | |
|---|---|
| ***F04B 39/04*** | (2006.01) |
| ***F04B 35/04*** | (2006.01) |
| ***F04B 39/00*** | (2006.01) |
| ***F04B 39/12*** | (2006.01) |

(52) U.S. Cl.
CPC ..... *F04B 39/042* (2013.01); *F04B 35/04* (2013.01); *F04B 39/0005* (2013.01);
(Continued)

(58) Field of Classification Search
CPC .. F04B 35/04; F04B 39/0005; F04B 39/0061; F04B 39/042; F04B 39/122;
(Continued)

(56) References Cited

U.S. PATENT DOCUMENTS 3,522,950 A * 8/1970 Schneck, Jr. ..... F16J 9/20 277/452
3,971,298 A * 7/1976 Kulig ..... F16J 9/16 92/248

(Continued)

FOREIGN PATENT DOCUMENTS

JP 2005-155438 A 6/2005
JP 2008-297924 A 12/2008

(Continued)

OTHER PUBLICATIONS

International Search Report for PCT/KR2018/003978 dated Jul. 19, 2018 from Korean Intellectual Property Office.

*Primary Examiner* — Bryan M Lettman
(74) *Attorney, Agent, or Firm* — Revolution IP, PLLC

(57) ABSTRACT

A cylinder coupling structure of a compact air compressor includes a block, a tubular-shaped cylinder assembled to the block, a valve cover which covers the valve assembly, and at least one pressurized bolt which assembles the valve cover and the block. A piston is reciprocated inside the cylinder. A stator is assembled to the block, a rotator is located to relatively rotate as to the stator, and a crank axis is assembled to the rotator to integrally rotate with the rotator to be axially supported in the block and to be rotatable. A connecting rod, each of both ends thereof is connected to the crank axis and the piston, respectively.

5 Claims, 13 Drawing Sheets

(52) U.S. Cl.
CPC ..... *F04B 39/0061* (2013.01); *F04B 39/122* (2013.01); *F04B 39/127* (2013.01)

(58) Field of Classification Search
CPC ..... F04B 39/127; F04B 39/00; F04B 39/023; F04B 39/04; F04B 39/10; F04B 39/12; F04B 39/121; F04B 39/005; F16J 15/56
See application file for complete search history.

(56) References Cited

U.S. PATENT DOCUMENTS

| | | | | |
|---|---|---|---|---|
| 5,123,662 | A * | 6/1992 | Sugimura | F16J 15/062 277/584 |
| 9,777,726 | B2 * | 10/2017 | Nagura | F04B 39/122 |
| 2014/0322040 | A1 * | 10/2014 | Cho | F04B 39/0061 417/312 |
| 2016/0305551 | A1 | 10/2016 | Koop et al. | |

FOREIGN PATENT DOCUMENTS

| | | | |
|---|---|---|---|
| JP | 2017-500509 | A | 1/2017 |
| KR | 20-0122684 | Y1 | 8/1998 |
| KR | 20-0387141 | Y1 | 6/2005 |
| KR | 10-2009-0112245 | A | 10/2009 |
| KR | 10-2010-0081807 | A | 7/2010 |
| KR | 10-1073763 | B1 | 10/2011 |
| KR | 10-1264371 | B1 | 5/2013 |

* cited by examiner

[Fig. 1]

Prior Art

[Fig. 5]
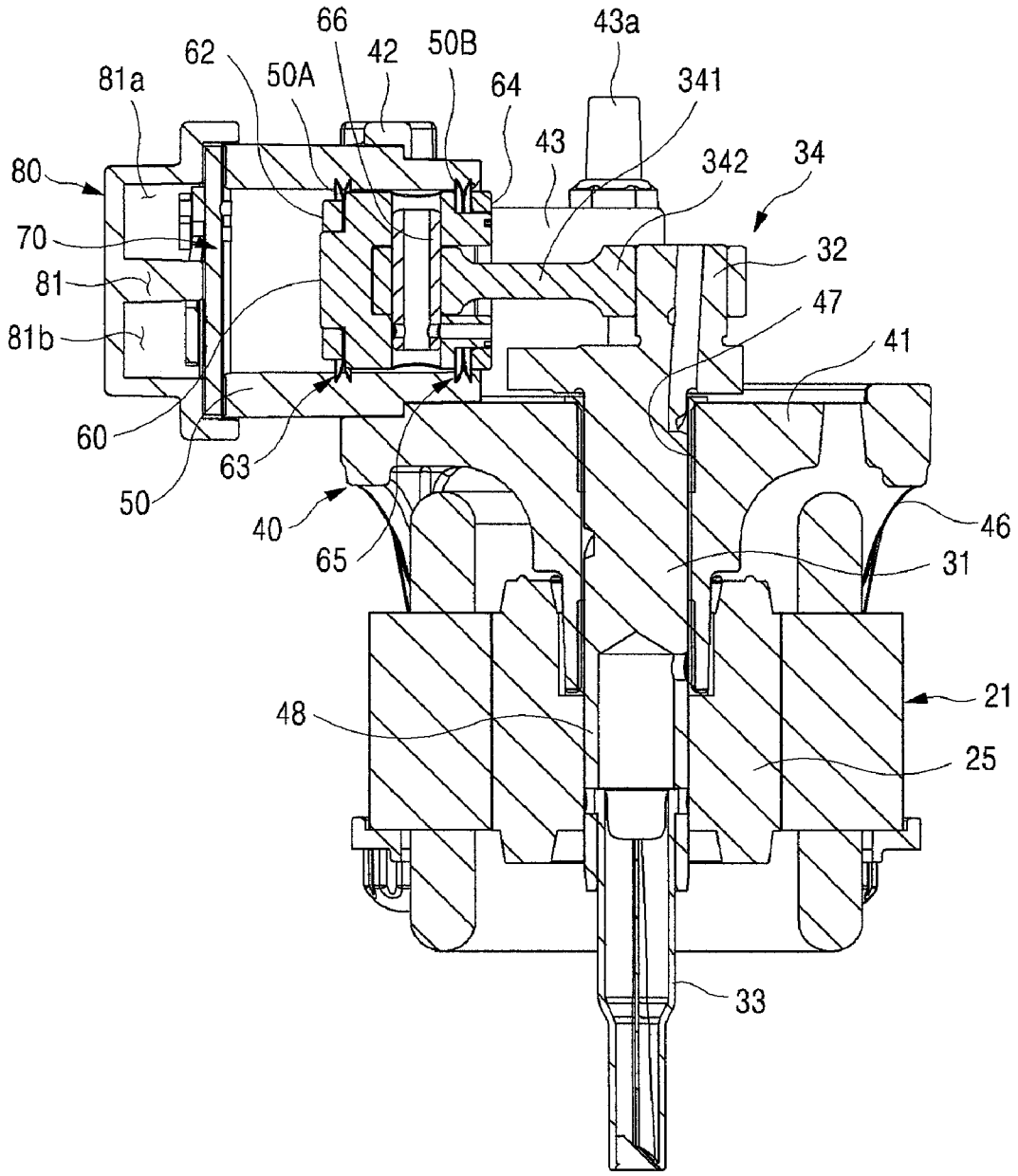

[Fig. 6]
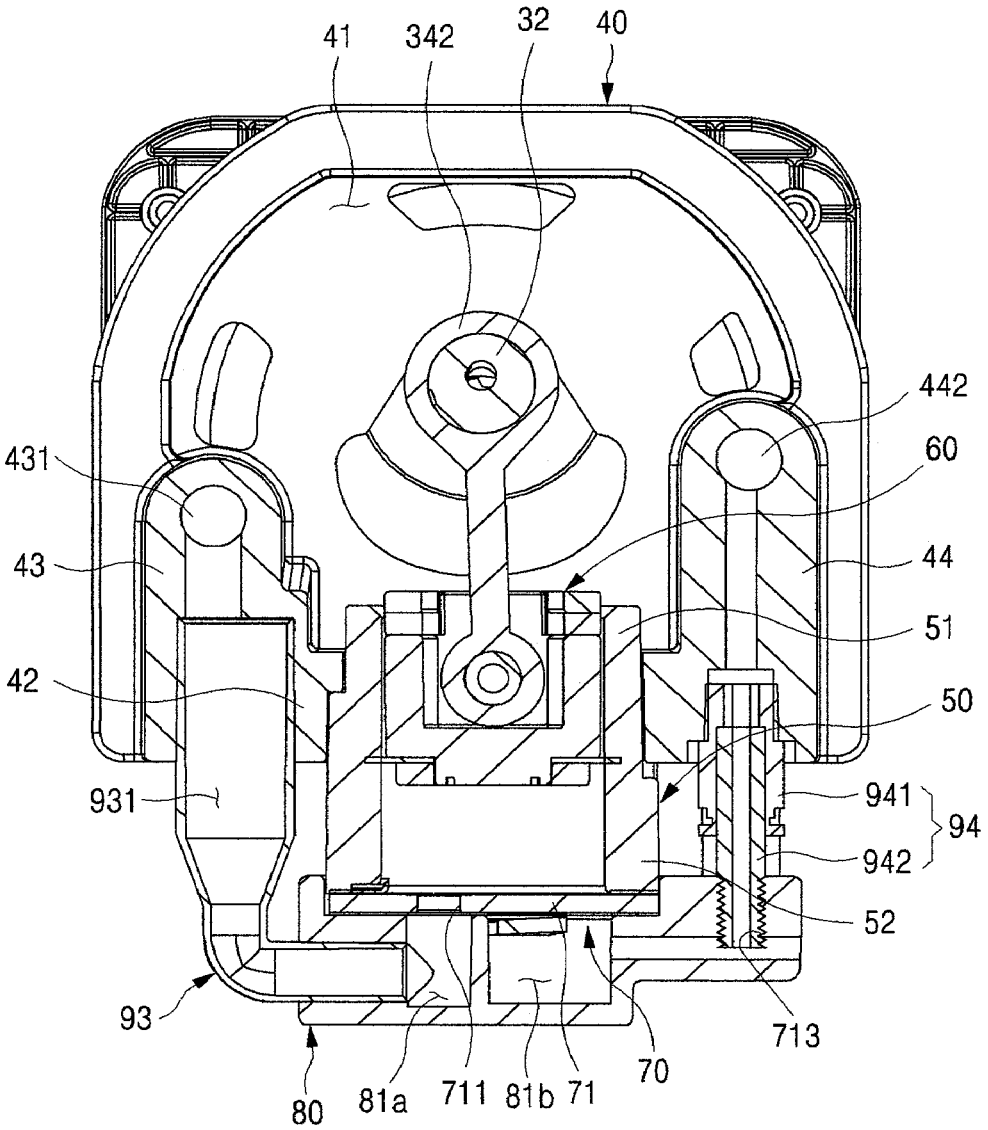

[Fig. 7]
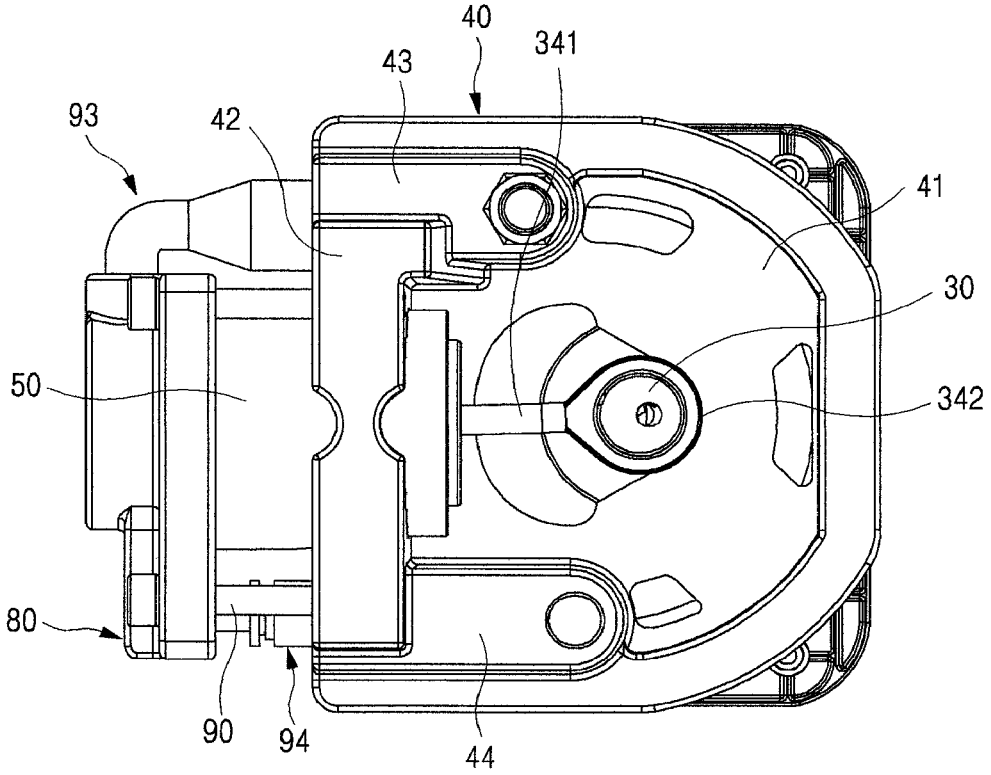
[Fig. 8]
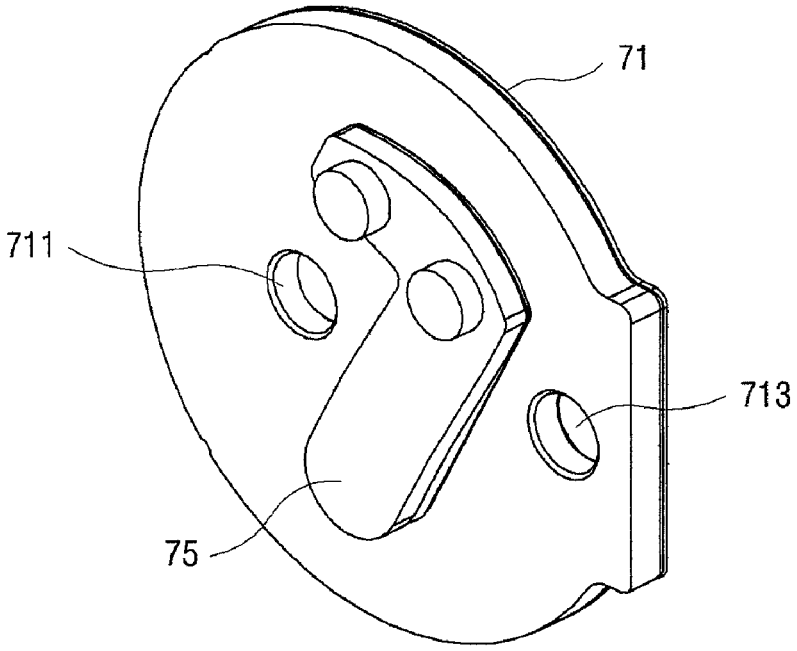

[Fig. 9]
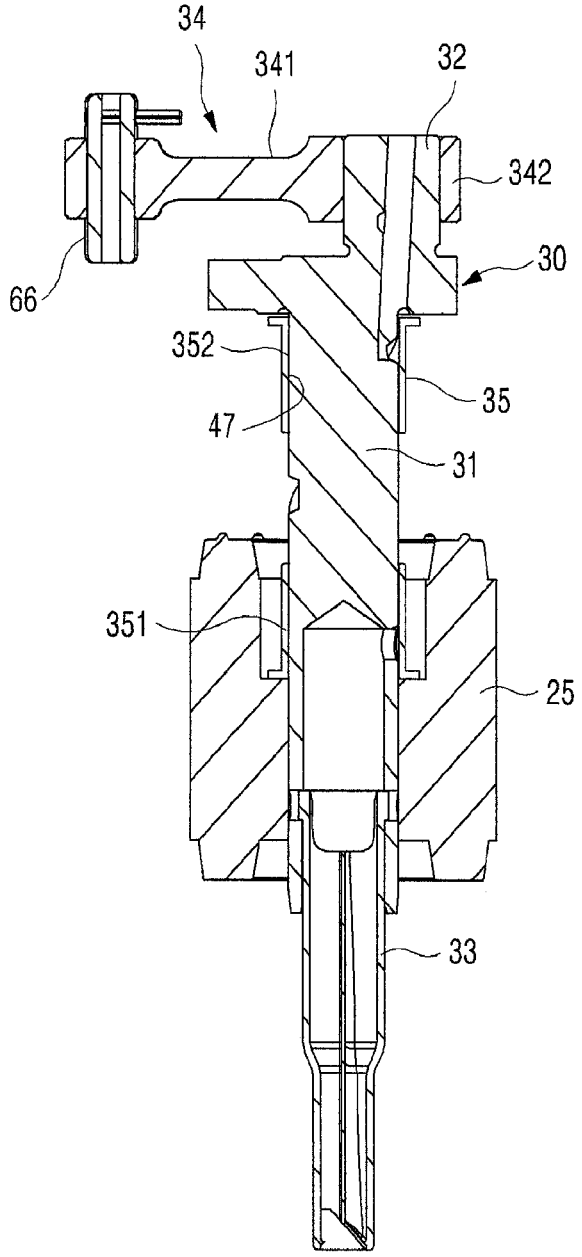

[Fig. 10]
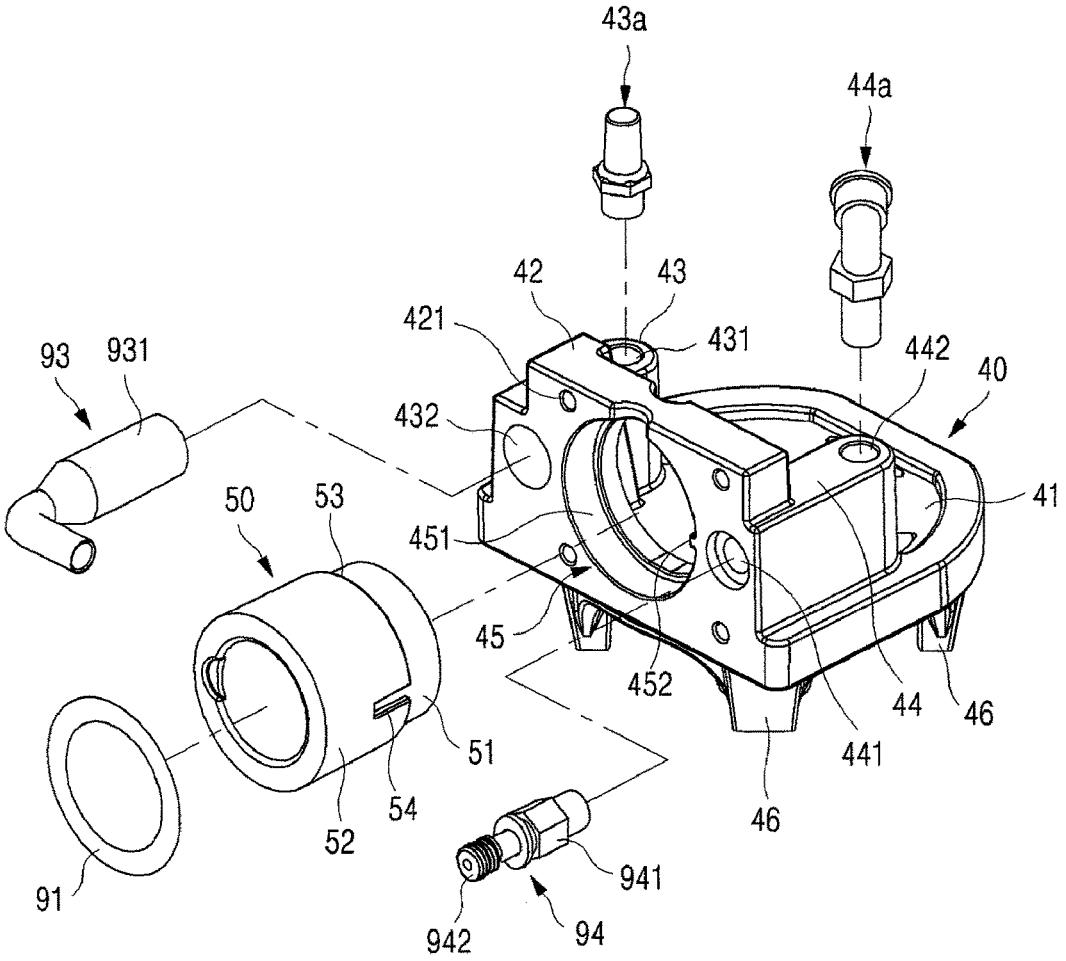

CYLINDER ASSEMBLE STRUCTURE FOR COMPACT AIR COMPRESSOR

TECHNICAL FIELD

The present invention relates to a compact air compressor. More specifically, the present invention relates to a cylinder coupling structure of a compact air compressor in which a cylinder of a reciprocating piston type compressor which sucks in fluid such as air or a refrigerant gas and compresses the same is manufactured separately from a block and coupled thereto to reduce the weight and the size of the compressor, thereby reducing the vibration and noise generated when the piston inside the cylinder is operated, and more securely, preventing the air or the refrigerant gas from leaking.

BACKGROUND ART

Compressors are used to produce compressed air or to compress fluid such as refrigerant gas. Compressors are mainly divided into reciprocating piston type compressors which reciprocate the piston in a cylinder to compress the air and rotary vane type compressors which rotate a rotator in the cylinder to compress the air. The rotary vane type air compressors make less noise, but there is a difficulty in the production of compact products, and thus are only applied to large-scale compressors having a horsepower of 20 HP or more. The reciprocating piston type compressors are mainly applied to products with various sizes having a horsepower of 20 HP or less.

Korean Utility Model Registration No. 20-0387141 discloses a reciprocating piston type compressor for compressing air, and Korean Patent No. 10-1073763, Korean Utility Model Registration No. 20-0122684, and Korean Patent Laid-Open No. 10-2010-0081807 disclose a compact reciprocating piston type, i.e., a reciprocating compressor for compressing refrigerants in a freezer.

FIG. 1 illustrates a compact reciprocating compressor disclosed in Korean Patent Laid-Open No. 10-2010-0081807. Referring to FIG. 1, the conventional ordinary compact reciprocating compressors for compressing refrigerant gas comprise a driving part P which generates a rotation power inside a case 1, and a compression part C which converts a rotational movement of the driving part P into a reciprocating movement to compress the refrigerant gas. The driving part P comprises a stator 2 which is elastically supported with a spring 2*a*, and a rotator 3 which is installed to be rotatable inside the stator 2.

The compression part C comprises a block 4 which is coupled to the stator 2 while being integrally formed with a cylinder part 4*a* so as to have a compression space, a crank axis 5 which is inserted into an axis supporting hole of the block 4 to be supported radially and axially, and is coupled to the rotator 3 of the driving part P to deliver a rotational force, a connecting rod 6 which is coupled to be rotatable to a cam part of the crank axis 5 to convert a rotational movement into a straight movement, a piston 7 which is coupled to be rotatable to the connecting rod 6 to compress the refrigerant while conducting a straight reciprocating movement in the cylinder 4*a*, a valve assembly 8 which is coupled to a front end of the cylinder 4*a* and comprises a suction valve and a discharge valve, a suction muffler 9*a* which is coupled to the suction side of the valve assembly 8, a discharge cover 9*b* which is coupled to accommodate the discharge side of the valve assembly 8, and a discharge muffler 9*c* which communicates with the discharge cover 9*b* to reduce discharge noise of the discharged refrigerant.

According to the compact reciprocating compressor as above, when power is applied by the driving part P, the rotator 3 rotates together with the crank axis 5 by the interaction force of the stator 2 and rotator 3, the connecting rod 6 coupled to the cam part of the crank axis 5 conducts a turning movement, the piston 7 coupled to the connecting rod 6 compresses the refrigerant sucked into the cylinder through the suction muffler 9*a* and discharges the same to the valve cover 9*b* while conducting a straight reciprocating movement in the cylinder 4*a*, and the refrigerant discharged to the valve cover 9*b* is discharged through the discharge muffler 9*c*.

However, the conventional compact reciprocating compressor as illustrated in FIG. 1 has disadvantages that the cylinder 4*a* gets bigger for being integrally formed with the block 4, thereby requiring more casting or die casting material for manufacturing the block 4 and making the cylinder heavier, and accordingly, the expenses for distribution such as shipping expenses, etc. would cost a lot.

In order to solve these problems of the conventional reciprocating piston type compressor, as illustrated in FIG. 1*b*, a compact reciprocating compressor having a structure in which a tubular-shaped cylinder 4*a*' is manufactured separately from a block 4' so that the valve cover 9*b*' and the block 4' are coupled by means of a pressurized bolt 9*b*'-1, which allows the valve cover 9*b*' to pressurize another end of the cylinder 4*a*' in a state where one end of the cylinder 4*a*' meets the block 4' and the valve assembly 8' is coupled to another end of the cylinder 4*a*' is disclosed.

Meanwhile, in the case of the compact reciprocating compressor illustrated in FIG. 1, the suction muffler 9*a* and the discharge muffler 9*b* for reducing the noise generated by the pulsation of the air or refrigerant gas compressed by the reciprocating movement of the piston 7 are manufactured separately from the block 4, and thus are connected to the valve cover 4 by means of a pipe. This makes the structure of the compressor to be complex and increases manufacturing costs.

Additionally, in the case of the compact reciprocating compressor illustrated in FIG. 1, the crank axis 5 is inserted into the axis supporting hole of the block 4 so that the end portions at both sides thereof are axially supported by a bearing 5*b* axially and radially. However, the crank axis 5 generates a lot of vibration, and due to the vibration, a ball bearing which is commonly used can be easily damaged, and fueling is required for sure in order to reduce the noise and improve durability. Accordingly, the conventional compact reciprocating compressor illustrated in FIG. 1*a* adopts a structure of pumping oil at a lower oil part of the case 1 by an oil feeder 5*a* to supply the oil to the bearing 5*b* through an oil passage 5*c* formed in the crank axis 5. Part of oil supplied as above is supplied to the cylinder 4*a* in order to reduce friction between the piston 7 and the cylinder 4*a*.

Meanwhile, FIG. 2 illustrates the structure of a piston of another conventional compact air compressor. In the past, a ring insertion groove 7*a*" which goes around an outer circumference is formed at the upper end portion of the piston 7" to which a connection rod 6" is connected to be rotatable, and an O-ring 7*b*" made of rubber for sealing the gap between the piston 7" and the inner surface of the cylinder is inserted into the ring insertion groove 7*a*". However, the conventional piston 7" has a structure where the O-ring 7*b*" installed at one side of the piston is adhered to the inner surface of the cylinder 4*a*, and thus the piston 7" vibrates to the left and right when the piston 7" reciprocates, and furthermore, the straightness of the piston greatly deteriorates, which results in the decline of the compressor performance. Also, since the O-ring 7" is made of rubber, the friction is high and the durability declines when in contact with the inner surface of the cylinder.

DISCLOSURE OF INVENTION

Technical Problem

It is an object of the present invention to provide a compact air compressor which has a simple structure and is easy to assemble by having a suction muffler and a discharge muffler integrally formed with a block, which reduces the vibration of the piston and prevents the air or refrigerant gas inside the cylinder from leaking by having a sealing ring installed in a front end part and a rear end part of the piston, respectively.

Solution to Problem

In order to achieve the above object, the compact air compressor according to the present invention is characterized by comprising a block, a tubular-shaped cylinder coupled to the block, a valve assembly provided with a suction valve and a discharge valve to block a front end of the cylinder, a valve cover covering the valve assembly so as to form a suction space and a discharge space at upper portion of the valve assembly, at least one pressurized bolt coupling the valve cover and the block so as to pressurize the cylinder between the valve cover and the block, a piston reciprocating inside the cylinder, a stator coupled to the block, a rotator located to rotate relatively with respect to the stator, a crank axis coupled to the rotator to rotate integrally with the rotator to be rotatable coaxially with the block, and a connecting rod, each of both ends thereof being connected to the crank axis and the piston, respectively, so as to convert a rotational movement of the crank axis into a straight reciprocating movement of the piston, wherein an O-ring is inserted into the ring insertion end formed at a front end part of the piston, and a fixing ring is inserted into the ring insertion end at the outer side of the O-ring to be coupled to the piston.

The present invention is characterized in that the O-ring is formed in the shape of a dish made of a Teflon material, and the front and rear O-rings face each other in the opposite directions to form a "V" shaped gap in the direction of an external diameter.

The present invention is characterized in that the O-ring is installed on each of the front end part and rear end part of the piston, and the thickness of the O-ring at the rear end part is formed to be thicker than the thickness of the O-ring at the front end part.

The present invention is characterized in that the fixing ring is coupled to the piston by allowing the part connected to the piston to be caulked while the fixing ring is inserted into the ring insertion end.

Advantageous Effects of Invention

Thanks to the above features, the compact air compressor according to the present invention forms the suction muffler and discharge muffler integrally with the block, and thus the vibration and noise of the piston can be reduced by installing sealing rings at both upper and lower ends of the piston, and wear resistance can be improved by forming the sealing rings with a Teflon material.

Additionally, according to the present invention, two dish-shaped O-ring inner diameter parts face each other to maintain the "V" shaped gap in the direction of the external diameter, and prevents incompressible gas which flows in from the rear side of the cylinder from flowing in, thereby reducing compression loss in the compressor stroke space, inhibiting the release of abnormal flow of oil, etc., and thus promoting performance improvement of the compact compressor.

Also, according to the present invention, the thickness of the O-ring at the rear end part is thicker than the thickness of the O-ring at the front end part, thereby promoting the improvement of straightness of the piston.

BRIEF DESCRIPTION OF DRAWINGS

FIG. 5 is a partially excerpted side cross-sectional view illustrating a compact air compressor to which a cylinder coupling structure according to an embodiment of the present invention is applied;

FIG. 6 is a horizontal cross-sectional view illustrating the compact air compressor to which the cylinder coupling structure according to an embodiment of the present invention is applied;

FIG. 7 is a plan view illustrating a compact air compressor to which the cylinder coupling structure according to an embodiment of the present invention is applied;

FIG. 8 is an excerpted perspective view illustrating a valve plate of the compact air compressor to which the cylinder coupling structure according to an embodiment of the present invention is applied;

FIG. 9 is a cross-sectional view illustrating a crank axis of the compact air compressor to which the cylinder coupling structure according to an embodiment of the present invention is applied;

FIG. 10 is an exploded perspective view illustrating a valve assembly of the compact air compressor to which the cylinder coupling structure according to an embodiment of the present invention is applied;

Figure 1:
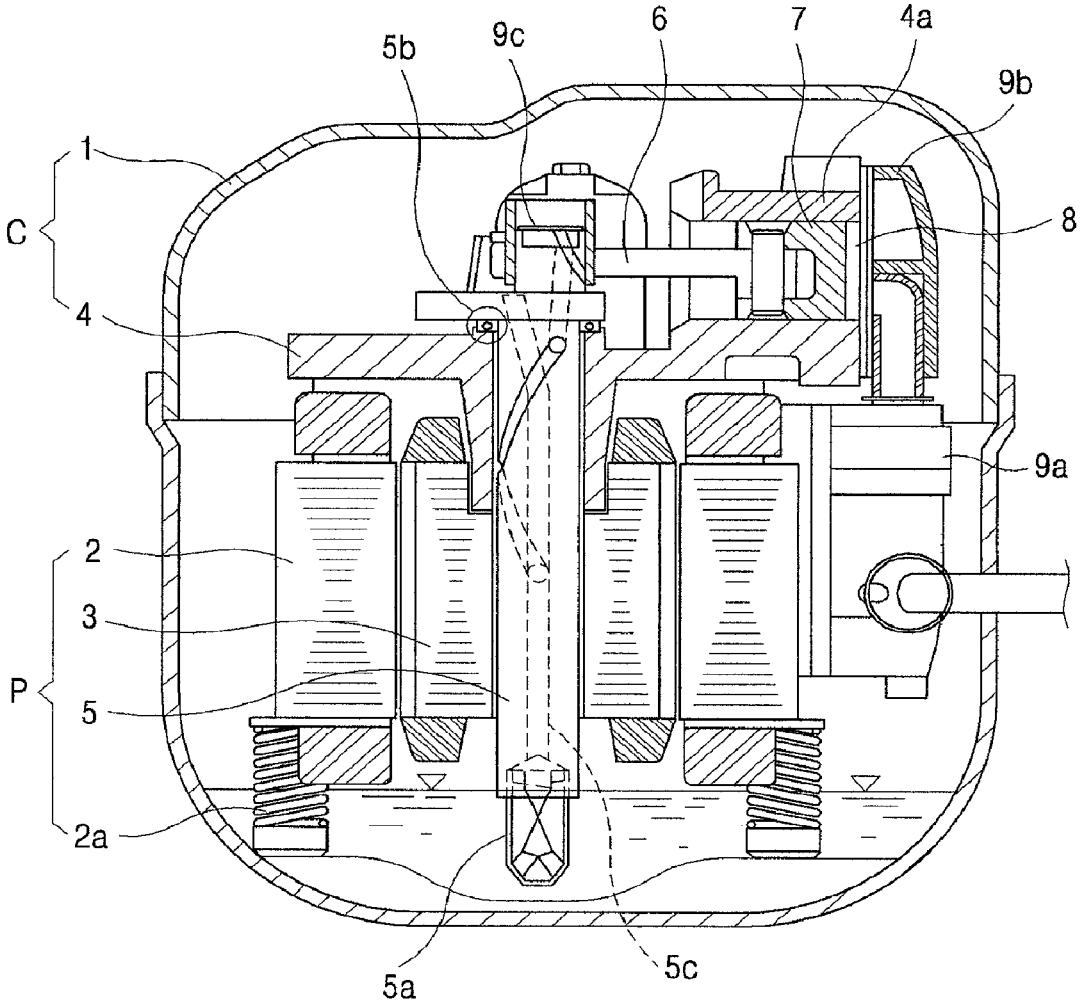
FIG. 1 is a drawing illustrating a structure of a conventional compact reciprocating compressor in which a cylinder is integrally formed with a block.
Figure 2:
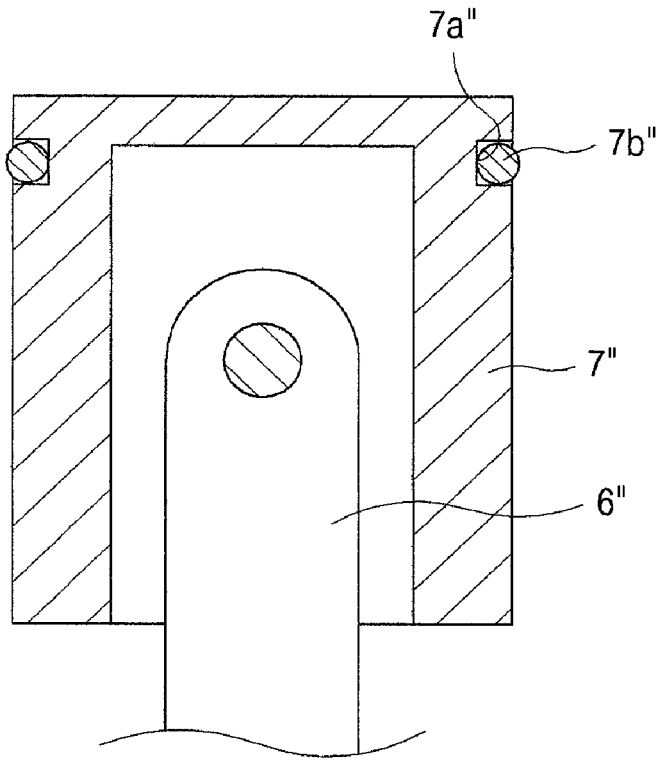
FIG. 2 is a cross-sectional view illustrating a structure of a piston of the conventional compact reciprocating compressor.
Figure 3:
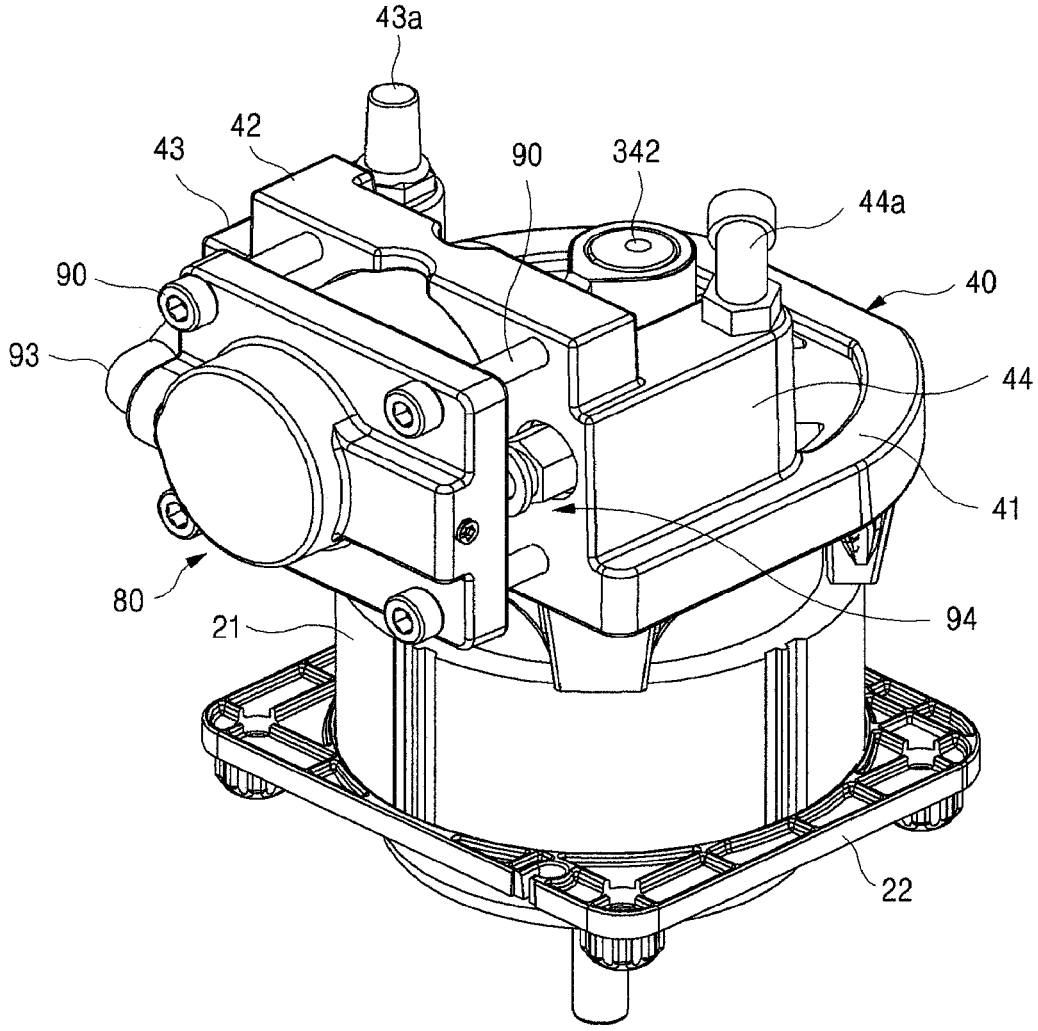
FIG. 3 is a perspective view illustrating a compact air compressor to which a cylinder coupling structure according to an embodiment of the present invention is applied.
Figure 4:
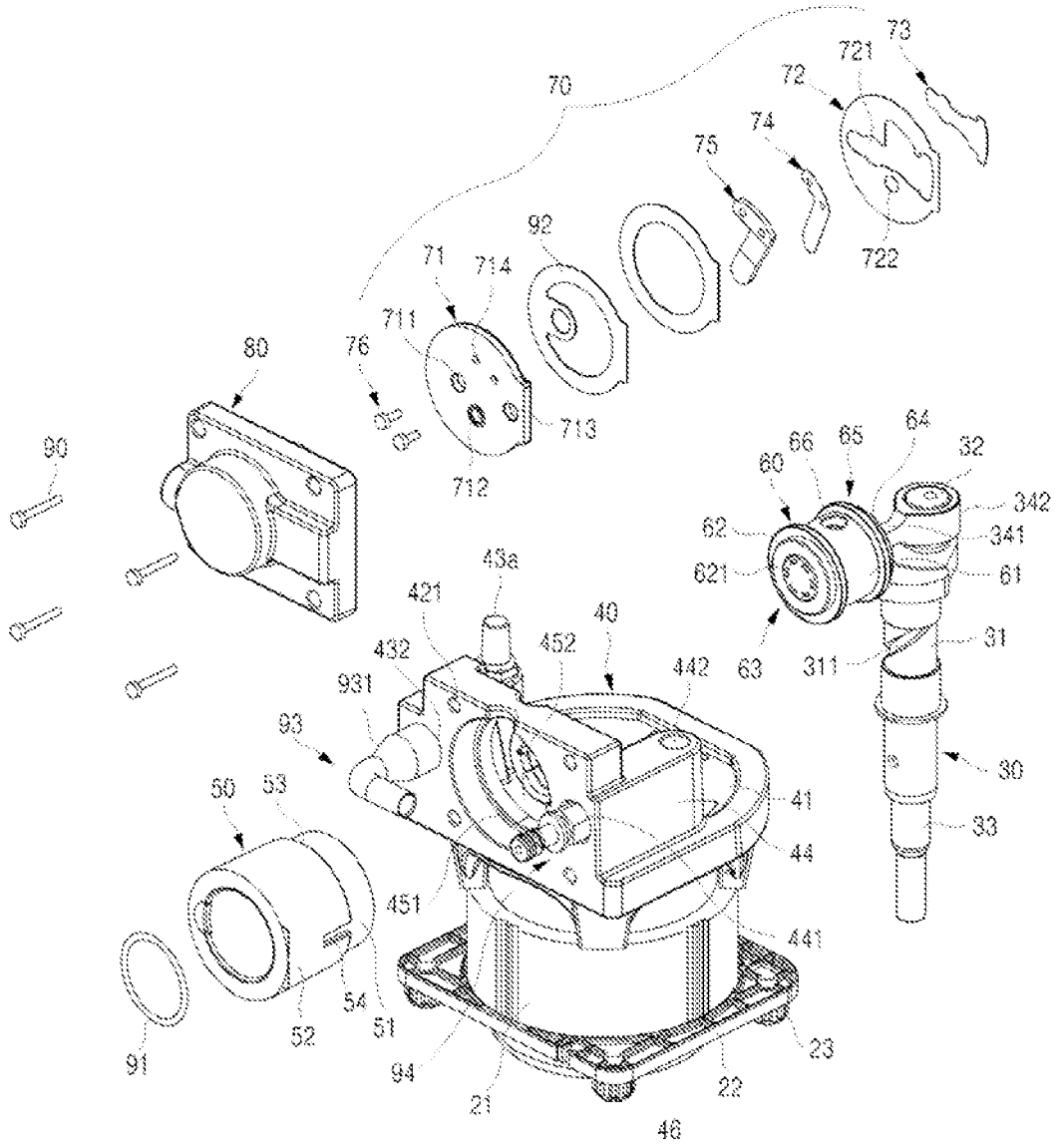
FIG. 4 is an exploded perspective view illustrating a compact air compressor to which a cylinder coupling structure according to an embodiment of the present invention is applied.
Figure 11:
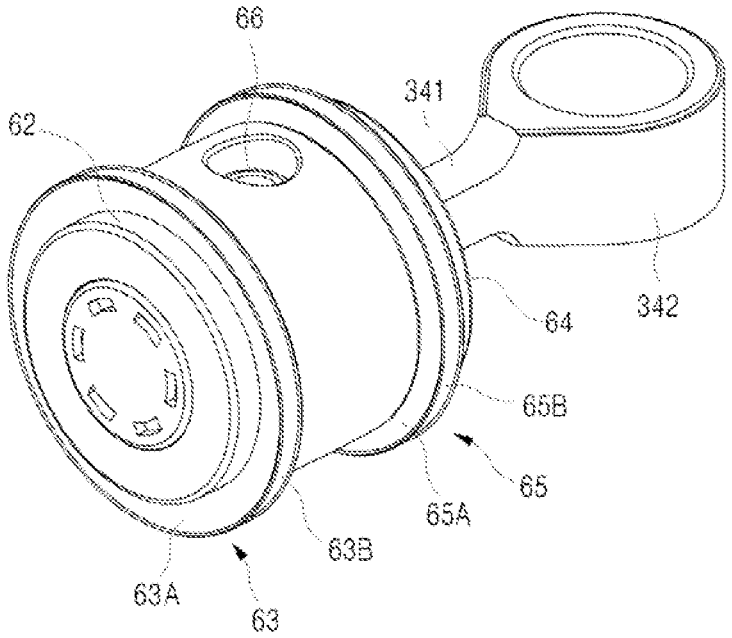
FIG. 11 is a perspective view illustrating a structure of a piston of the compact air compressor to which the cylinder coupling structure according to an embodiment of the present invention is applied.

Hereinafter, the present invention will be explained in detail with reference to the attached drawings.

MODE FOR THE INVENTION

Referring to the attached drawings, the compact air compressor to which the cylinder coupling structure according to an embodiment of the present invention is applied comprises a housing, a stator 21, a rotator 25, a crank axis 30, a connecting rod 34, a block 40, a cylinder 50, a piston 60, a valve assembly 70, a valve cover 80, and a pressurized bolt 90.

Although the housing is not illustrated, the housing is a case generally used for accommodating an assembly thereof so that the assembly in which the stator 21, the block 40, etc. are assembled could be protected, and comprises a bottom part, a side wall part which is extended upwardly from an outer edge of the bottom part and formed in a tubular shape whose upper and lower sides are open, and a cover part for covering an upper opening of the side wall part. The bottom part, the side wall part and the cover part are integrally coupled in a state where each of the bottom part and the side wall part is sequentially placed up and down so as to block the upper and lower openings of the cover part. The housing is sealed to block the noise generated during the pumping operation and to prevent oil such as lubricating oil, etc. from leaking outside.

The stator 21 generates a magnetic force for rotating the rotator 25 when electricity is applied, and is fixed to the bottom part of the housing. In order to be fixed, the stator 21 is coupled to a fixed plate 22 in an upright position, and the fixed plate 22 to which the stator 21 is coupled is fixed to the bottom part of the housing by an assembling bolt.

As will be mentioned later, the stator 21 meets a stator coupling pillar 46 protruding downwardly from an axis supporting part 41 of the block 40 to be integrally coupled to the block 40.

The rotator 25 is located inside the stator 21 to rotate relatively with respect to the stator 21. The crank axis 30 is coupled to the rotator 25 to rotate integrally with the rotator 25.

The crank axis 30 is coupled to the rotator 25 to rotate integrally with the rotator 25 to be rotatable coaxially with the block 40. Referring to the drawings, the crank axis 30 is integrally formed with a crank part 32 in which the connecting rod 34 is connected to an upper portion of an axis part 31, and an oil feeder 33 for moving the lubricating oil contained in the bottom part of the housing to the crank axis 30 is coupled to a lower portion of the axis part 31. The lubricating oil pumped by the oil feeder 33 is supplied to the surface of the crank axis 30 following an oil passage 311 such as a groove or a hole formed in the crank axis 30.

The axis part 31 of the crank axis 30 is axially supported in the axis supporting part 41 of the block 40. An axis hole 47 penetrating up and down is formed in the axis supporting part 41 of the block 40, and the axis part 31 is inserted to be rotatable and axially supported in a journal 35 inserted into the axis hole 47.

The crank part 32 of the crank axis 30 is a feature relating to cam mechanism for converting the rotation of the crank axis 30 into the reciprocating movement of the piston 60 together with the connecting rod 34.

Each of both ends of the connecting rod 34 is connected to the crank axis 30 and piston 60, respectively, so as to convert a rotational movement of the crank axis 30 into a straight reciprocating movement of the piston 60. Referring to the drawings, the connecting rod 34 is divided into a rod part 341 which is connected to the piston 60 by a connecting pin 66, and a journal part 342 connected to the crank part 32 of the crank axis 30. The divided rod part 341 and the journal part 342 are integrally connected.

The block 40 axially supports the crank axis 30, and allows the cylinder 50 to be coupled.

According to the present invention, a cylinder 50 is not integrally formed with the block 40, but is formed separately to be coupled to the cylinder coupling part 42 of the block 40. Referring to the drawings, the block 40 has a horizontal plate-shaped axis supporting part 41 in which the crank axis 30 is axially supported, and a plate-shaped cylinder coupling part 42 which is upright to the axis supporting part 41.

An axis supporting hole 47 is formed in the axis supporting part 41 of the block 30, and a tubular-shaped journal 35 is insertedly fixed in the axis supporting hole 47. The crank axis 30 is inserted and axially supported in the journal 35.

The journal 35 smoothly supports the rotation of the crank axis 30 and is formed of materials having wear resistance such as bronze, so that the crank axis 30 directly contacts the journal by sliding to be supported thereby.

Figure 13:
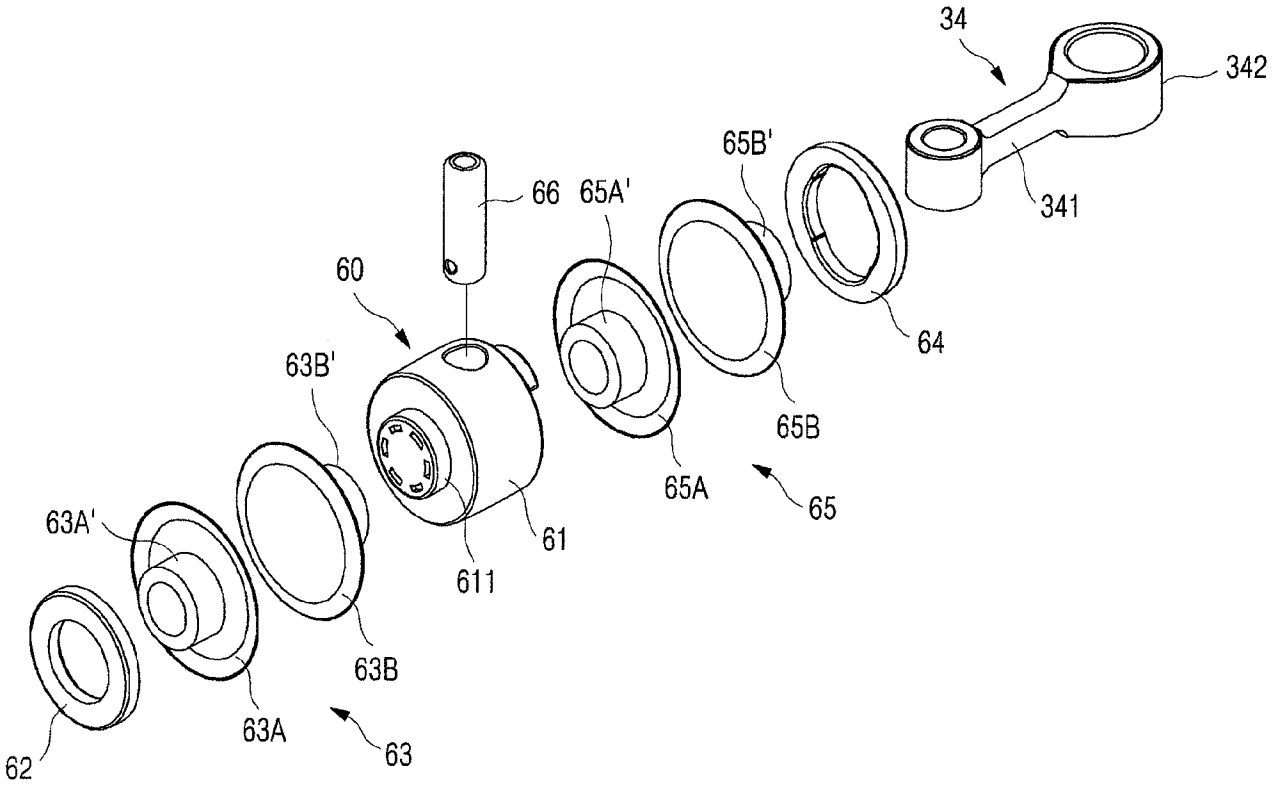
FIG. 13 is an exploded perspective view illustrating a structure of a piston of the compact air compressor according to another embodiment of the present invention.
Figure 14:
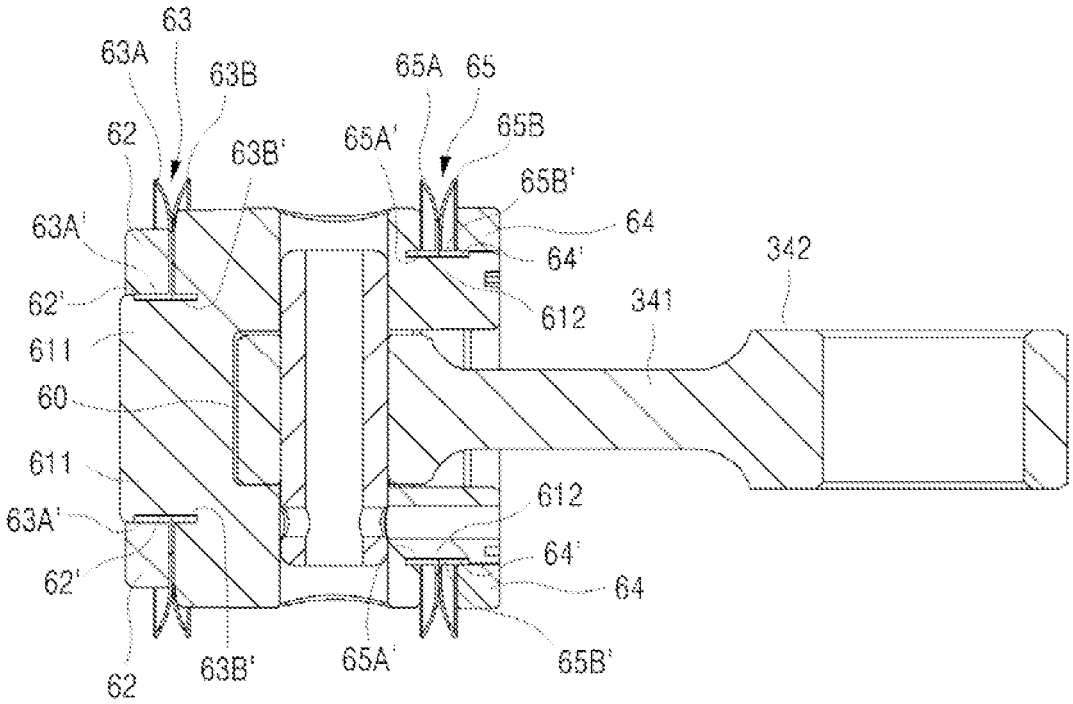
FIG. 14 is a cross-sectional view of an embodiment according to FIG. 13.

Meanwhile, the present invention may have a structure where the crank axis 30 is not directly supported by the journal 35, but is supported by bushings 351, 352 made of a resin material coupled to each inlet at both sides of the journal 35, and illustrates the embodiment where the bushings 351, 352 made of a resin material such as poly phenylene sulfide (PPS) having excellent heat resistance and wear resistance are inserted into each inlet at both sides of the journal 35, and the axis part 341 of the crank axis 30 is inserted into the bushings 351, 352 and is supported thereby. As illustrated in FIG. 13, when the crank axis 30 is supported by the bushings 351, 352 made of a resin material, the present invention may have a structure reducing the fueling of oil or an oil-free axial support structure which does not require fueling at all. In the case of oil-free axis support, the feature relating to an oil feeder 33 or an oil passage 311 described in the above may be deleted from the present invention, and accordingly, it becomes easier to reduce weight and size.

The present invention has a structure where the cylinder 50 is manufactured separately from the block 40 and coupled to the cylinder coupling part 42 of the block 40. A cylinder insertion hole 45 which is arranged to be perpendicular to the axis supporting hole 47 is formed in the cylinder coupling part 42. The cylinder insertion hole 45 is formed to have one end part of the cylinder 50 inserted into the cylinder coupling part 42 and penetrated therethrough. The cylinder insertion hole 45 is divided into a part where the inner diameter at a side in which the crank axis 30 is located is smaller and a part where the inner diameter at a side opposite to the crank axis 30 is larger to form a step, and by the step, a supporting end 451 for supporting an engagement end 53 of the cylinder 50 is formed. The cylinder 50 is inserted into the cylinder insertion hole 45, so that the engagement end 53 is engaged and supported in the supporting end 451 formed by the step formed in an inner wall of the cylinder insertion hole 45.

In the cylinder insertion hole 45, a guide protrusion 452 corresponding to the guide groove 54 formed in the outer wall of the cylinder 50 is formed to be long in the longitudinal direction along the inner wall of the cylinder insertion hole 45 at a part where the inner diameter is larger in order to guide the insertion of the cylinder 50. While the cylinder 50 is inserted into the cylinder insertion hole 45, the guide protrusion 452 is inserted into the guide groove 54 formed at the outer surface of the cylinder 50 so that the cylinder 50 is inserted into the cylinder insertion hole 45 while moving only in the longitudinal direction.

Meanwhile, the present invention has a structure where the suction muffler 43 and the discharge muffler 44 are integrally formed with the block 40 in order to reduce the noise generated by the pulsation of fluid generated during the pumping operation. Referring to the drawings, the suction muffler 43 and the discharge muffler 44 are formed at each of both sides of the axis supporting part 41 by which the axis is supported. Especially, the cylinder coupling part 42 is located between the suction muffler 43 and discharge muffler 44. Each end portion of the suction muffler 43 and the discharge muffler 44 is connected to each of both sides of the axis supporting part 41, and thus is interconnected with each other in a structure arranged in the shape of "⊏" in the order of the suction muffler 43, the cylinder coupling part 42 and the discharge muffler 44, thereby forming a structure where rigidity of the block 40 is reinforced. An inlet 431 through which the fluid flows in and an outlet 432 through which the fluid is discharged are formed in the suction muffler 43. A suction filter 43*a* for filtering impurities included in the air or refrigerant sucked in is coupled to the inlet 431 of the suction muffler 43, and a suction connection pipe 93 is connected to the outlet 432 of the suction muffler 43, and accordingly the suction muffler 43 is connected to the suction space 81*a* of the valve cover 80. Additionally, an inlet 441 through which the fluid flows in and an outlet 442 through which the fluid is discharged are formed in the discharge muffler 44. A discharge connection pipe 94 is connected to the inlet 441 of the discharge muffler 44, and accordingly the discharge muffler 44 is connected to the discharge space 81*b* of the valve cover 80, and a pipe connection hole 44*a* is coupled to the outlet 442 of the discharge muffler 44.

The cylinder 50 is formed in the shape of a circular tube so as to form a space where fluid such as air or a refrigerant is compressed by the reciprocating movement of the piston 60. The present invention is characterized in that the cylinder 50 is formed separately from the block 40 and coupled to the block 40. Especially, an engagement end 53 is formed at the side part of the cylinder 50 so that the engagement end 53 is engaged in and supported by the supporting end 451 formed inside the cylinder insertion hole 45 of the block 40. Referring to the drawings, the cylinder 50 has a small diameter part 51 with a small external diameter formed at the side inserted into the cylinder insertion hole 45 of the block 40, and a large diameter part 52 whose external diameter is greater than the small diameter part 51 formed at the side to which the valve assembly 70 and the valve cover 80 are coupled. The step formed by the small diameter part 51 and large diameter part 52 becomes the engagement end 53. The small diameter part 51 is inserted into a part having a small inner diameter in the cylinder insertion hole 54, and the large diameter part 52 is inserted into a part having a large inner diameter in the cylinder insertion hole 54, and accordingly the engagement end 53 is engaged in and supported by the supporting end 451 of the cylinder insertion hole 54. In other words, the pressurized bolt 90 fastens the block 40 and the valve cover 80 so that the cylinder 50 is coupled to the block 40, which allows the valve cover 90 to pressurize the front end of the cylinder 50 while the engagement end 53 of the cylinder 50 is engaged in and supported by the supporting end 451. As mentioned above, a guide groove 54 to have a guide protrusion 452 formed on the inner surface of the cylinder insertion hole 45 inserted therein is formed on the outer surface of the cylinder 50 so that the cylinder 50 is guided while being inserted into the cylinder insertion hole 45 without rotating while the cylinder 50 is inserted into the cylinder insertion hole 45 and coupled to the block 40. Referring to the drawings, the guide protrusion 452 is formed by cutting the large diameter part 52 in the longitudinal direction of the cylinder 50 in a predetermined depth starting from the engagement end 53 of the cylinder 50.

Meanwhile, the drawings illustrate an embodiment where the guide protrusion 452 is formed on the inner surface of the cylinder insertion hole 45, and the guide groove 54 is formed on the outer surface of the cylinder 50, but they may be formed at opposite locations. In other words, contrary to the illustrated drawings, the guide protrusion may be formed on the outer surface of the cylinder 50, and the guide groove may be formed on the inner surface of the cylinder insertion hole 45.

The piston 60 reciprocates inside the cylinder 50 so as to compress and discharge fluid such as air or a refrigerant sucked into the cylinder 50. The piston 60 is connected to the connecting rod 34 by the connecting pin 66 so as to convert a rotational movement of the crank axis 30 into a straight movement, and then conduct the straight reciprocating movement.

Figure 12:
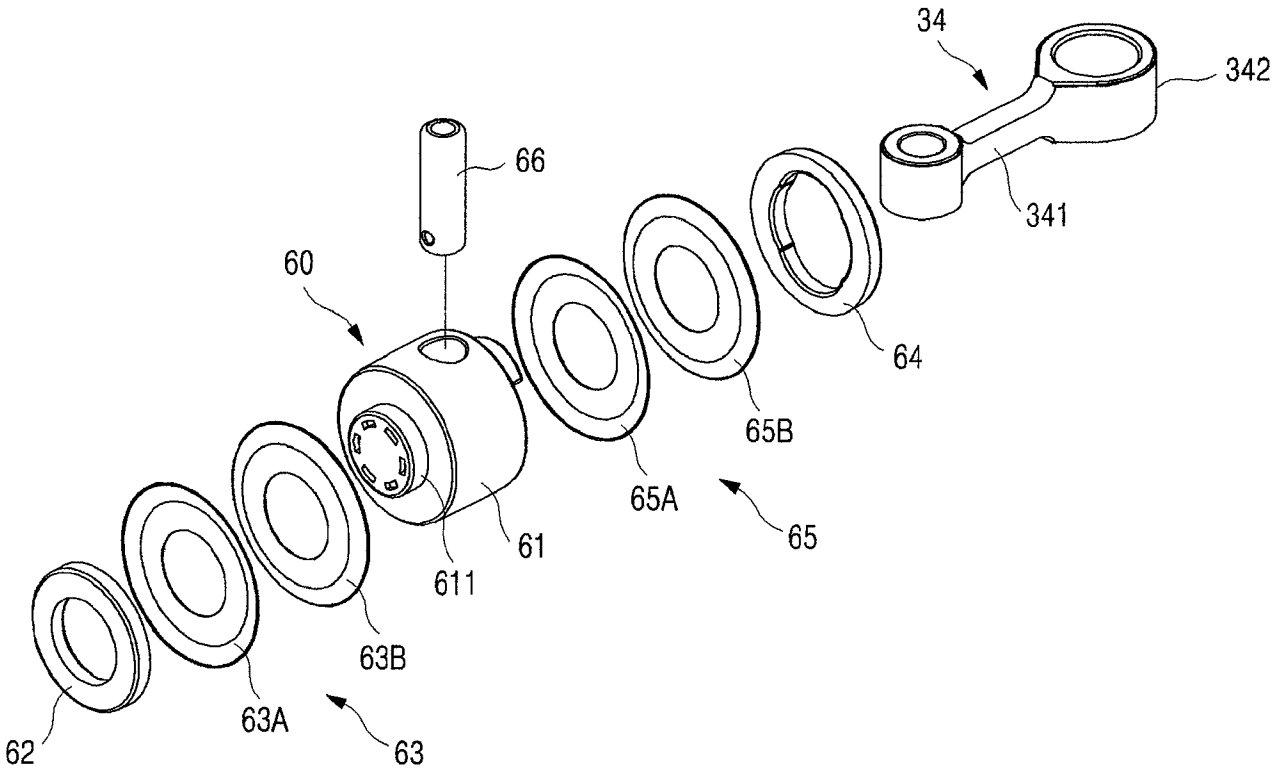
FIG. 12 is an exploded perspective view illustrating a structure of a piston of the compact air to which the cylinder coupling structure according to an embodiment of the present invention is applied.

By the features as above, the present invention has a structure which can improve the assembling efficiency and compressive sealing property of the piston 60. FIG. 12 illustrates a structure of this piston 60 in detail. Referring to FIG. 12, the piston 60 has a structure where double O-rings 63, 65 are installed on each of the front end part and the rear end part of the tubular-shaped body 61 whose front end is closed and rear end is open.

However, the present invention may have the double O-ring 63 installed on a ring insertion end 611 at the front end part of the body 61, and an annular O-ring installed instead of the O-ring 65 on a ring insertion end 612 at the rear end part.

The double O-rings 63, 65 installed on each of the front end part and the rear end part are formed in the shape of a dish and is made of a Teflon material or a silicon materials having great heat resistance and elasticity. Additionally, the front and rear O-rings 63A, 63B and 65A, 65B face each other in the opposite directions to form a"V" shaped gap in the direction of the external diameter, thereby coupling the O-rings to the ring insertion ends 611, 612, respectively.

Additionally, the thickness of the O-ring 65 at the rear end part may be formed to be thicker than the thickness of the O-ring 63 at the front end part, and the thickness of O-rings 63B, 65B at the rear end may be formed to be much thicker than the thickness of O-rings 63A, 65A at the front end among each of the double O-rings 63, 65.

The outer circumference of each O-ring 63, 65 at the front end part and the rear part end may be inserted into each O-ring insertion groove 50A, 50B at the front end and rear end formed on an inner circumferential surface of the cylinder 50, thereby promoting sealing properties.

FIG. 13 illustrates, as an embodiment modifying the O-rings 63, 65 of the present invention, that annular fixed pieces 63A', 63B' and 65A', 65W are connected to the outer side of the inner diameter of the front and rear O-rings 63A, 63B and 65A, 65B in each of the double O-rings 63, 65, respectively, and the annular fixed pieces 63A', 65W are inserted into insertion grooves 62', 64' formed in each of the fixing rings 62, 64, and the annular fixed pieces 63W, 65A' are inserted into insertion grooves 611', 612' formed in each of the ring insertion ends 611, 612, thereby preventing the double O-rings 63, 65 from deviating and maintaining sealing properties when operating the piston.

According to the present invention, as above, the O-rings 63, 65 are installed on each of the front end and the rear end, so that the front end and the rear end are closely supported in the inner surface of the cylinder 50, and thus the sealing property may be improved, thereby preventing the piston 60 from vibrating inside the cylinder 50. In the present invention, the O-rings 63, 65 are made of a Teflon material, not a rubber material, thereby securing the sealing property and mechanical nature such as wear resistance, which results in reducing or eliminating the fueling of oil to implement an oil-free structure. Especially, by adopting the O-rings 63, 65 made of a Teflon material as above so that the O-rings 63, 65 can be coupled to the piston 60 easily, the present invention has a structure where the O-rings 63, 65 are coupled to the piston 60 by cutting and forming ring insertion ends 611, 612 in each of a front end part and a rear end part of the body 61 of the cylinder 50, inserting the O-rings 63, 65 into each of the cut insertion ends 611, 612 in order, and inserting fixing rings 62, 64 in the outer side thereof to fix the piston 60. The fixing rings 62, 64 are press-fitted in the ring insertion ends 611, 612 to be coupled to the piston 60. Additionally, simultaneously with the press-fitting coupling or separately from the press-fitting coupling, the fixing rings 62, 64 can be coupled to the body 61 of the piston 60 by allowing the part connected to the body 61 of the piston 60 to be caulked while the fixing rings 62, 64 are inserted into the ring insertion ends 611, 612.

Among the O-rings 63, 65, the O-ring 63 coupled to the front end part of the piston body 61 mainly acts in sealing the cylinder 50 and the piston 60. The present invention forms the O-ring 63 coupled to the front end part of the body 61 with a Teflon material or a silicon material having great heat resistance and elasticity, maintains the external diameter of the O-ring 63 to which the front and rear dish-shaped O-rings 63A, 63B are coupled to each other at the front end part of the body 61 to have a"V" shaped gap so as to endure the compression pressure, and the thickness of the O-ring 63A at the front end is formed to be thinner than the thickness of the O-ring 63B at the rear. Therefore, straightness is excellent when the piston 60 goes straight to the front, and as the O-rings 63A, 63B at the front and rear ends of the O-ring 63 inserted into the O-ring insertion groove 50A at the front end formed on an inner circumferential surface of the cylinder 50 deviate, the external diameter of the O-rings 63A, 63B at the front end moves being adhered to the inner circumferential surface of the cylinder 50 while it tilts to the back, and thus sealing properties could be maintained even better. Therefore, the double O-rings 63, 65 are installed on each of the front end part and the rear end part of the body 61 of the piston 60 to conduct the operation as above, thereby reducing the vibration and noise of the piston 60, and preventing the incompressible gas which flows in from the rear side of the cylinder 50 from flowing in, so as to reduce compression loss in the compression stroke space, and inhibit the release of abnormal flow of the oil, etc., to promote the performance improvement of the compact compressor.

The valve assembly 70 comprises a suction valve and a discharge valve to block the front end of the cylinder. The valve assembly 70 comprises a valve plate 71 which blocks the front end opening of the cylinder 60. A suction space 81*a* formed by the valve cover 80 and a suction hole 711 which connects the compressed space formed inside the cylinder 50 are formed in the valve plate 71. Additionally, a discharge space 81*b* formed by the valve cover 80 and a discharge hole 712 which connects the compressed space formed inside the cylinder 50 are formed in the valve plate 71. A suction valve flip 73 made of an elastic material is coupled to the inner side of the valve plate 71 so that the suction hole 711 is open only in the direction where the fluid is sucked in from the suction space 81*a* to the compressed space of the cylinder 50, and a discharge valve flip 74 made of an elastic material is coupled to the outer side of the valve plate 71 so that the discharge hole 712 is open only in the direction where the fluid is discharged from the compressed space of the cylinder 50 to the discharge space 81*b*.

Meanwhile, in order to prevent the discharge valve flip 74 from being excessively open, a valve stopper 75 is coupled to the outer side of the valve plate 71 so as to be located on the upper portion of the discharge valve flip 73. The valve stopper 75 has a shape corresponding to the discharge valve flip 73, and is coupled to the discharge valve flip 73 and the outer side of the valve plate 71 at the same time by a rivet 76 coupled to a rivet fastening hole 714 formed in the valve plate 71.

Meanwhile, a discharge hole 713 to which a discharge connection pipe 94, which connects the discharge space 81*b* and the discharge muffler 44, is connected is formed in the valve plate 71 so that the compressed fluid discharged to the discharge space 81*b* of the valve cover 80 could be discharged to the discharge muffler 44.

The valve assembly 70 coupled as above is placed to block the front end opening of the cylinder 50, and thus is coupled to the cylinder 50 by the fastening of the pressurized bolt 90 together with the valve cover 80. In order to seal the part in contact with the cylinder 50, a cylinder gasket 91 is provided in the edge of the front end opening of the cylinder 50, and a plate gasket 72 is provided in an inner side surface of the valve plate 71. In the plate gasket 72, a flip mount hole 721 which has the suction valve flip 73 mounted thereon is formed, and a discharge hole 722 is formed so that the discharge hole 712 of the valve plate is not blocked.

The valve cover 80 covers the valve assembly so as to cover the upper portion of the valve assembly 70 and to form a suction space 81*a* and a discharge space 81*b* on the upper portion of the valve assembly 70. A diaphragm 81 for dividing the suction space 81*a* and the discharge space 81*b* is formed in the inner side of the valve cover 80, and coupled to the upper portion of the valve plate 71 so as to cover the upper portion of the valve plate 71 in the state having the cover gasket 92 interposed therein for sealing. The present invention has a structure where the valve cover 80 is coupled to the block 40 by the pressurized bolt 90, so that the valve cover 80 presses the valve plate 70, and then the cylinder 50 is pressurized to be coupled to the block 40.

As mentioned above, the pressurized bolt 90 is a feature for having the cylinder 50, the valve assembly 70, and the valve cover 80 integrally coupled to the block 40. Referring to the drawings, in a state where the cylinder 50 and the valve assembly 70 are placed between the valve cover 80 and the block 40 in order, the pressurized bolt 90 allows a bolt head to be engaged in the valve cover 80 and a bolt front end to be screw-fastened to the block 40, so that the engagement end 53 of the cylinder 50 is engaged in the supporting end 451 of the cylinder insertion hole 45 so that the cylinder 50 is pressurized to be coupled to the block 40.

The suction connection pipe 93 is in a tubular shape for connecting the suction muffler 43 and the suction space 81*a* of the valve cover 80. Referring to the drawings, one end of the suction connection pipe 93 is connected to the outlet 432 of the suction muffler 43, and another end thereof is connected to the inlet formed in the suction space 81*a* of the valve cover 80. Meanwhile, the present invention is characterized in that a supplemental suction muffler part 931 is formed in the suction connection pipe 93 in order to reduce the noise resulting from the suction pulsation of the fluid together with the suction muffler 43. The supplemental suction muffler part 931 is achieved by an expanded space.

The discharge connection pipe 94 is in a tubular shape for connecting the discharge muffler 44 and the discharge space 81*b* of the valve cover 80. Referring to the drawings, one end of the discharge connection pipe 94 is connected to the inlet 441 of the discharge muffler 44, and another end thereof is connected to the discharge hole 713 formed in the discharge space 81*b* of the valve cover 80.

Meanwhile, the present invention has a structure where the discharge connection pipe 94 is divided into a pit pipe 942 and a pit 941 and then the two are coupled so that the discharge connection pipe 94 could be easily assembled while the cylinder 50, the valve assembly 70 and the valve cover 80 are coupled to the block 40 by a pressurized bolt 90. Referring to the drawings, the pit pipe 942 is coupled to the discharge hole 713 of the valve plate 71 to be protruded in a direction where the valve cover 80 pressurizes the cylinder. Additionally, the pit 941 proceeds in a direction where the valve cover 80 pressurizes the cylinder 50, and is protruded in a direction facing the pit pipe 942 so that the pit pipe 942 is insertedly connected, thereby being connected to the inlet 441 of the discharge muffler 44.

In the drawings, the pit pipe 942 is insertedly coupled to the pit 941. However, this was for the sake of convenience, and the pit pipe 942 is coupled to the valve plate 71 in advance, and the pit pipe 942 and the pit 941 are coupled to each other by having a distal end of the pit pipe 942 is inserted into the inlet of the pit 942 connected to the discharge muffler 44 when assembling the valve cover 80.

The cylinder coupling structure of the compact air compressor explained in the above and illustrated in the drawings is merely an example and should not be interpreted to limit the technical idea of the present invention. The scope of protection of the present invention should be determined only by the matters recited in the following claims, and it should be interpreted that improvements and modified embodiments which do not deviate from the gist of the present invention fall within the scope of protection of the present invention.

The invention claimed is:

1. A cylinder coupling structure of an air compressor, comprising:

a block (40);

a tubular-shaped cylinder (50) coupled to the block (40);

a valve assembly (70) provided with a suction valve and a discharge valve to block a front end of the tubular-shaped cylinder;

a valve cover (80) covering the valve assembly (70) so as to form a suction space and a discharge space at an upper portion of the valve assembly (70);

at least one pressurized bolt (90) coupling the valve cover 80 and the block (40) so as to pressurize the tubular-shaped cylinder (50) between the valve cover (80) and the block (40); a piston (60) reciprocating inside the tubular-shaped cylinder (50);

a stator (21) coupled to the block (40);

a rotator (25) located to rotate relatively with respect to the stator (21);

a crankshaft (30) coupled to the rotator to rotate integrally with the rotator (25) to be rotatable coaxially with the block (40); and a connecting rod (34), each of both ends thereof being connected to the crankshaft and the piston, respectively, so as to convert a rotational movement of the crankshaft into a straight reciprocating movement of the piston (60), wherein the piston (60) has double O-rings (63, 65) installed on each of the front end part and the rear end part of a tubular-shaped body (61) whose front end is closed and rear end is open, the double O-rings having a first double O-ring (63) and a second double O-ring (65), the first double O-ring having a first front O-ring (63A) and a first rear O-ring (63B), the second double O-ring having a second front O-ring (65A) and a second rear O-ring (65B), wherein, a first front annular fixed piece (63A') is connected to an outer side of an inner diameter of the first front O-ring (63A), and protruded from a center of the first front O-ring, a first rear annular fixed piece (63B') is connected to an outer side of an inner diameter of the first rear O-ring (63B), and protruded from a center of the first rear O-ring, a second front annular fixed piece (65A') is connected to an outer side of an inner diameter of the second front O-ring (65A), and protruded from a center of the second front O-ring, and a second rear annular fixed piece (65B') is connected to an outer side of an inner diameter of the second rear O-ring (65B), and protruded from a center of the second rear O-ring, wherein, the first front annular fixed piece (63A') is inserted into a first front insertion groove (62') formed in a first fixing ring (62), the first rear annular fixed piece (63B') is inserted into a first rear insertion groove (611') formed in a first ring insertion end (611), the second front annular fixed piece (65A') is inserted into a second front insertion groove (612') formed in a second ring insertion end (612), and the second rear annular fixed piece (65B') is inserted into a second rear insertion groove (64') formed in a second fixing ring (64).

2. The cylinder coupling structure of the air compressor of claim 1, wherein the double O-rings (63, 65) are formed in the shape of a dish and are made of a silicon material having heat resistance and elasticity, and the first front O-ring (63A) and the first rear O-ring (63B) as well as the second front O-ring (65A) and the second rear O-ring (65B) face each other in opposite directions to form a "V" shaped gap in the direction of an external diameter.

3. The cylinder coupling structure of the air compressor of claim 2, wherein the thickness of the first rear O-ring (63B) at the rear end part is formed to be thicker than the thickness of the first front O-ring (63A) at the front end part.

4. The cylinder coupling structure of the air compressor of claim 1, wherein the first double O-ring (63) is installed on the first ring insertion end (611) at the front end part of the tubular-shaped body (61) and an annular the second double O-ring (65) is installed on the second ring insertion end (612) at the rear end part.

5. The cylinder coupling structure of the air compressor of claim 1, wherein the thickness of the second double O-ring (65) at the rear end part is formed to be thicker than the thickness of the first double O-ring (63) at the front end part.

* * * * *